United States Patent [19]

Bouko et al.

[11] Patent Number: 4,774,520

[45] Date of Patent: Sep. 27, 1988

[54] PRIMARY MICROWAVE SOURCE FOR A CONICAL SCANNING ANTENNA AND AN ANTENNA CONTAINING IT

[75] Inventors: Jean Bouko; Jean Claude Durand; Jean Le Foll; Francois Salvat, all of Paris, France

[73] Assignee: Thomson CSF, Paris, France

[21] Appl. No.: 361,846

[22] Filed: Mar. 25, 1982

[30] Foreign Application Priority Data

May 22, 1981 [FR] France ..... 81 10250

[51] Int. Cl.[4] ..... H01Q 13/00

[52] U.S. Cl. ..... 343/783; 343/762; 343/763

[58] Field of Search ..... 343/762, 363, 779, 365, 343/780, 783, 785; 333/21 A

[56] References Cited

U.S. PATENT DOCUMENTS

| | | | |
|---|---|---|---|
| 2,599,864 | 6/1952 | Harvie et al. | 343/783 |
| 2,774,067 | 12/1956 | Bollinger et al. | 343/762 |
| 3,491,362 | 1/1970 | Van Der Wal et al. | 343/762 |
| 3,831,177 | 8/1974 | Soong | 343/783 |

*Primary Examiner*—Theodore M. Blum

*Attorney, Agent, or Firm*—Cushman, Darby & Cushman

[57] ABSTRACT

A microwave primary source with a phase conical scan having a conical horn containing an obstacle which gives rise to a wave that propagates in the $TE_{21}$ mode in quadrature with the $TE_{11}$ fundamental mode in the opening of the horn; the obstacle is driven in rotation round the axis V of the horn.

9 Claims, 3 Drawing Sheets

FIG_3-a
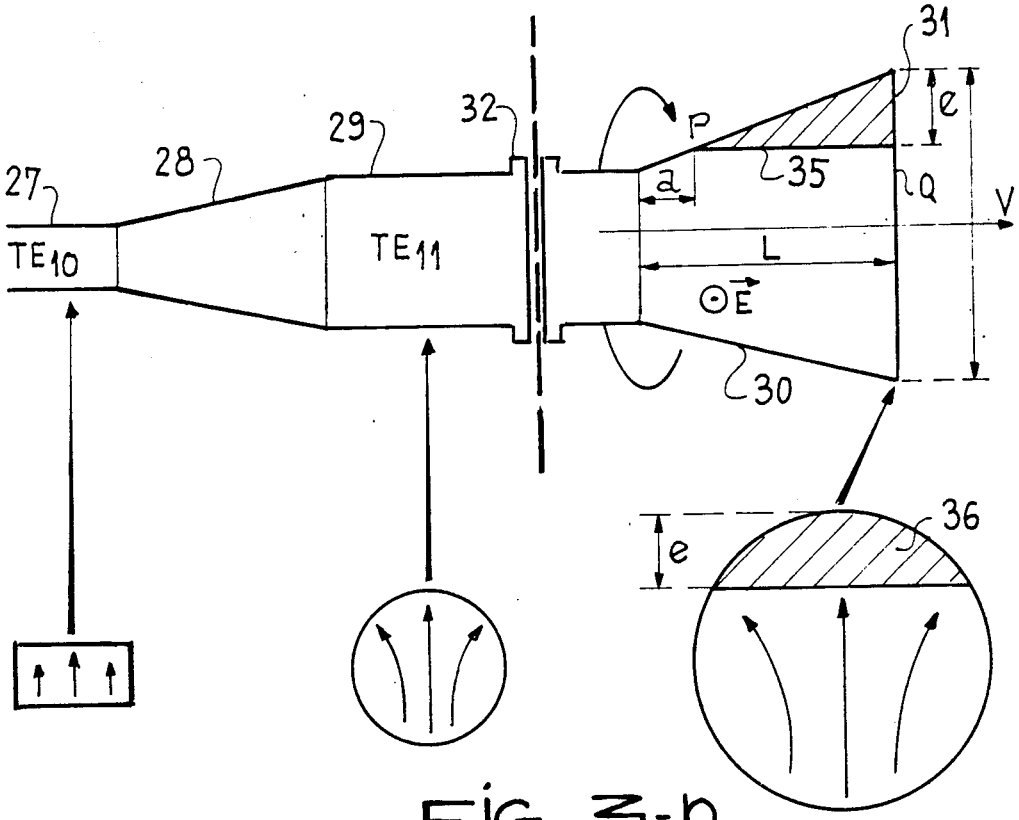
FIG_3-b
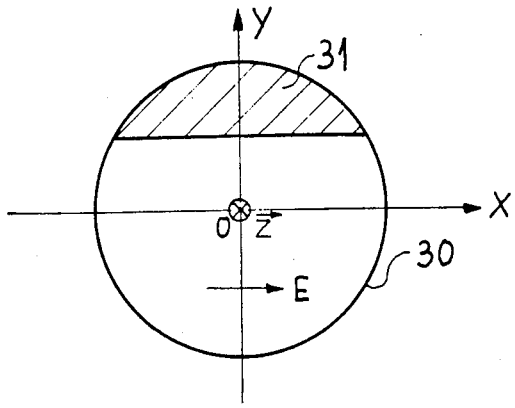

FIG_4-a
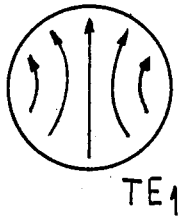
FIG_4-b
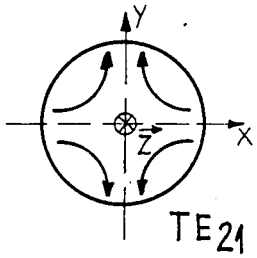
FIG_4-c
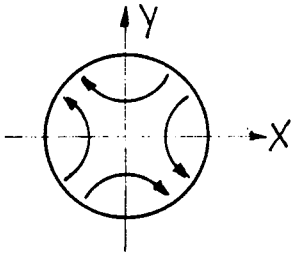
FIG_5
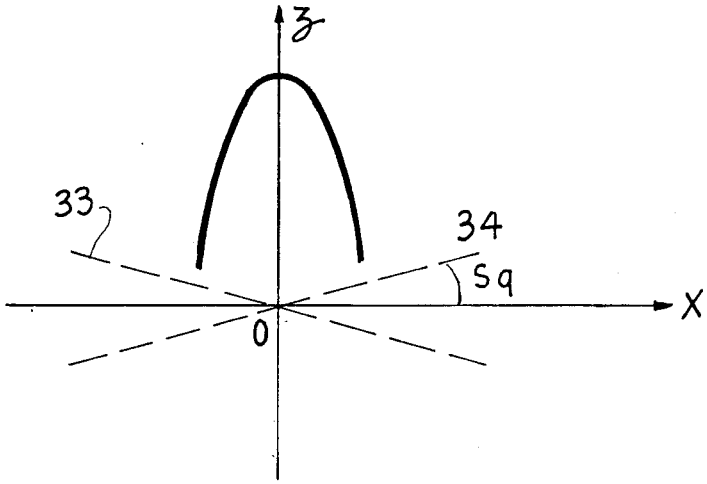
FIG_6-a
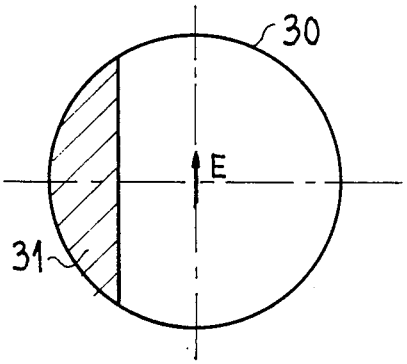
FIG_6-b
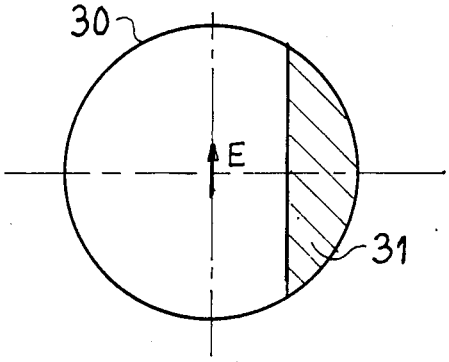

PRIMARY MICROWAVE SOURCE FOR A CONICAL SCANNING ANTENNA AND AN ANTENNA CONTAINING IT

The present invention relates to a primary source for a conical scanning antenna and more especially a phase conical scanning antenna. Conical scan antennas are most often associated with radar systems used for tracking and it is useful to recall briefly what is a conical scan assembly even though such an assembly is well known to specialists and there are descriptions in books.

In an amplitude conical scanning assembly containing a focussing system, the antenna is illuminated by a primary source and its phase centre describes, round the focal axis of the system, a circle of given radius situated in the focal plane. For such an antenna, the radiation diagram is no longer centred on the axis of the focussing system. Rather, it rotates in space so that the direction of maximum radiation describes a cone whose half angle at the apex is called the antenna squint angle. In the absence of a focussing system, the conical scan may be obtained by means of a rotating source tilted with respect to its axis of revolution, the phase centre being on this axis. In such an assembly, however, the radiation diagram being the same both for transmission and reception, it is possible, by analyzing the transmission diagram, to determine the frequency of rotation and use this knowledge for jamming purposes.

In a phase conical scan assembly, the phase centre of the radiation transmitted describes a circle situated in a plane perpendicular to the direction of maximum radiation of the antenna.

As the radiation diagram on transmission is centred on the antenna axis, it is no longer possible to determine the frequency of rotation and then to jam it.

However, some realizations of microwave sources given in the U.S. patent Ser. No. 104 837 of Dec. 18, 1974, which are reproduced schematically in FIGS. 1 and 2 of the present description, can give rise to certain mechanical constraints which it is desirable to avoid.

Figure 1:
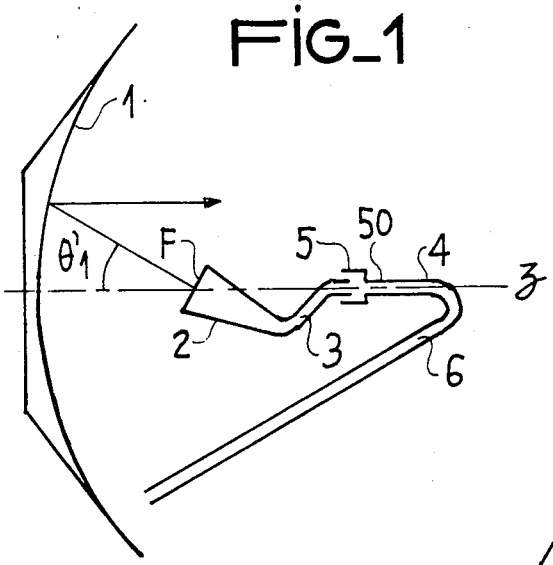

Hence, in the realization in FIG. 1 an inclined primary source 2 is made to rotate in front of a reflector 1 so that its phase centre remains fixed at the antenna system focal point F. For this rotation to be obtained, a bent supply wave guide 3 must be provided which is connected to a rotary joint 5 that is itself connected to a bent wave guide 6 through a transition 4 which changes the passage of the circular section wave guide 50 to the rectangular section wave guide 6.

In such a realization, it is necessary that the source be carefully balanced dynamically and, also, the mechanics are relatively complicated.

Figure 2:
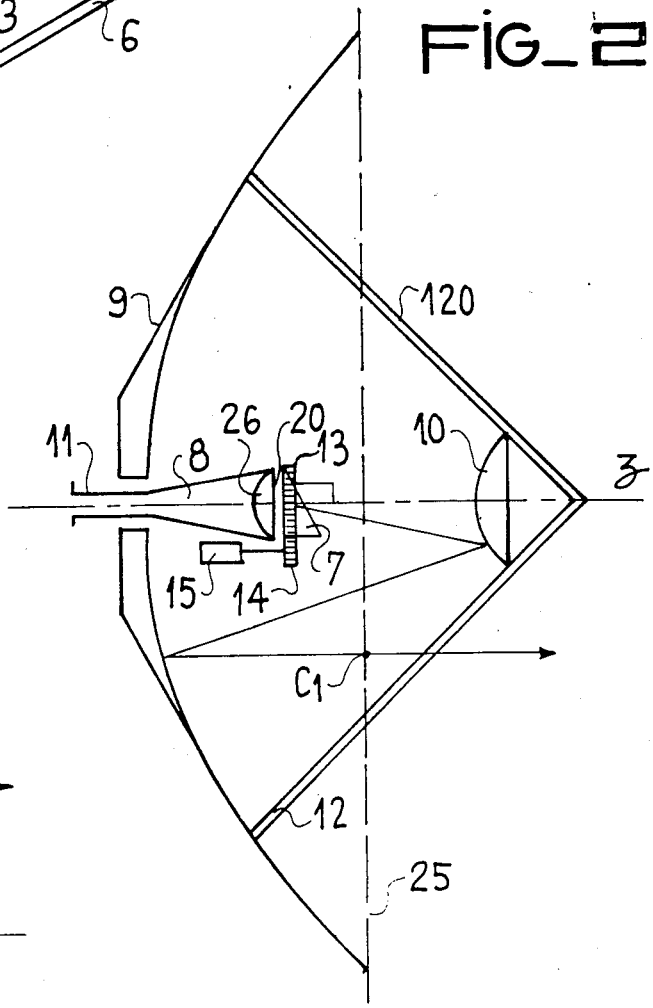

In the realization in FIG. 2, to obtain the phase conical scan, a prism 7 is used, which rotates in front of a fixed axial primary source 8 in a Cassegrain antenna. The prism is made of a natural or artificial dielectric material. The antenna contains a main reflector 9 and an auxiliary reflector 10, both of them revolving round axis oz, the auxiliary reflector being held by arms 12–120. Primary source 8, which is a circular corrugated horn, is connected to a supply by wave guide 11. When rotating, driven round axis oz by a toothed crown 13, which engages a crown 14 fixed to a motor 15, prism 7 causes the phase centre of the waves emitted by horn 8 to rotate in a plane parallel to the antenna aperture. This phase centre C1 of the waves emitted moves in the aperture plane 25.

However, in such a production, the fitting of a prism in front of the horn aperture of the primary source may cause an interference amplitude modulation for certain frequencies of rotation for which the phase centre is no longer stable and make necessary the fitting of a lens 26 in the aperture 20 of horn 8.

Also, the radiation diagram deviation angle is small and the pass band narrow.

The purpose of the present invention is a microwave primary source which enables a phase conical scan to be obtained which is free of the disadvantages of prior practice just described both from the electrical and mechanical points of view.

In accordance with the invention, a microwave primary source for a phase conical scan antenna comprises a conical horn energized by a fixed circular wave guide in fundamental mode $T_{11}$ and said horn comprises an obstacle which gives rise to a wave that propagates in mode $TE_{21}$ 90° out of phase with the wave in mode $TE_{11}$ in the aperture plane, means being provided to cause the electric field lines in mode $TE_{21}$ to rotate and make the beam deviate in the plane of symmetry of the obstacle.

The invention will be well understood from the following description and the figures which accompany it, in which, apart from FIGS. 1 and 2 referring to prior practice.

Figure 7:
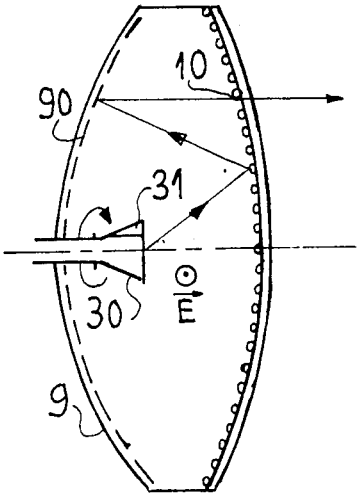

FIGS. 3*a* and 3*b* show schematically a source in accordance with the invention seen in section along a plane containing the direction of propagation and a perpendicular plane, FIGS. 4*a*–4*c* show schematically the electric field distributions of the two waves in the horn aperture plane, FIG. 5 shows the radiation characteristics of an antenna using the source of the invention, FIGS. 6*a* and 6*b* show the extreme positions that the obstacle can adopt in the horn, FIG. 7 shows the use of reflectors and polarization rotation.

A source in accordance with the invention, shown in section in FIG. 3A, contains an input wave guide 27 in which a wave in the fundamental mode $TE_{10}$ propagates. This wave guide is connected to a transition 28 from a rectangular to a circular wave guide followed by a circular wave guide 29 in which a wave in the fundamental mode $TE_{11}$ is propagating. The electric field as it is shown by $\overline{E}$ is perpendicular to the section plane.

A conical horn 30 is fed by wave guide 27. An obstacle 31 is placed in the horn near its aperture. Its general form is that of a half cone resting on the horn wall as is seen in FIG. 3A with its axis parallel to the horn axis. It is formed by a dielectric of constant $\epsilon$ whose value is usually between 1 and 4.5 with a low loss angle or by a metal comparable to that of those currently used in the manufacture of radar sources, copper or aluminium for example. If e is its thickness, L the horn length, a the distance between the horn aperture and the obstacle point P, the distance a is about one twelfth of length L. If $\phi_1$ and $\phi_2$ are respectively the horn opening and aperture diameters, e is between $\phi_1/6$ and $\phi_1/4$ depending on the slope required for the angular discrimination curves. Obstacle 31 converts part of the energy propagating in the $TE_{11}$ mode into energy propagating in the $TE_{21}$ mode and higher modes whose propagation is supposedly prevented by the horn dimensions.

FIG. 3B is a view in the opening plane Q. If a reference OX is chosen with Y orthogonal such that OX is a plane of symmetry for obstacle 31, a distribution of the electric field for the mode $TE_{11}$ is obtained in accordance with FIG. 4A and for the mode $TE_{21}$, supposedly in phase, as in FIG. 4B.

In accordance with the invention, the characteristics of obstacle 31, its length in particular, are chosen so that, in the plane of opening Q, the electric field distribution of the mode $TE_{21}$ is as in FIG. 4C. As can be seen, there is a change from the distribution in FIG. 4B to that in FIG. 4C by a rotation of 45° which can be obtained by shifting the wave propagating in the mode $TE_{21}$ with respect to the propagating in the mode $TE_{11}$ by $\pi/4$.

The distribution of the resulting electric field projected along OY has the following characteristics:

the fields at two symmetrical points with respect to OY are complex conjugates one with respect to the other. They have therefore the same amplitude but opposing phases.

the fields at two symmetrical points with respect to OX are equal. As is well known, the Fourier transform enables the radiation diagram to be obtained. If the radiation diagram is calculated for the polarization parallel to OY from a distribution with the above characteristics, the maximum intensity is obtained in a direction $\theta$ of the XOZ plane in which $\theta$ is the direction of the field concerned.

When the distribution represented in FIG. 4C is made to rotate with respect to that shown in FIG. 4B, a rotation of the maximum current in the XOZ plane is obtained without amplitude modulation. This is obtained by rotation of:

either the obstacle 31 with respect to the horn 30 which is held fixed with respect to wave guide 29, or the horn 30 to which the obstacle 31 is fixed with respect to wave guide 29.

In FIG. 3A can be seen a rotating joint 32 which, by means of a gear system that is not shown, enables horn 30 in which obstacle 31 is fixed to be made to rotate. The means enabling obstacle 31 only to be rotated in the horn are not shown. This solution, which is possible, is complicated however and will probably not be used in practice. This rotation produces the phase conical scan. During this rotation, the phase centre remains on the horn axis. If a reflector is illuminated with such a rotating source, a secondary diagram is obtained whose maximum amplitude is on the focal axis of the assembly and the phase centre remains on this axis.

FIG. 5 shows, in the XOZ plane, the amplitude characteristic related to an antenna using a primary source of the type described above for the two extreme positions shown in FIGS. 6A and 6B.

In FIG. 5, the straight line 33 gives the phase for the obstacle placed as shown in FIG. 6A and the straight line 34 gives it for the obstacle placed as shown in FIG. 6B. Straight lines 33 and 34 with the horizontal OX give the squint angle Sq. In space, the phase diagram describes a cone of revolution.

As the obstacle can be made of a metal, copper or aluminium, which is often used in the manufacture of radar sources, it may be noted that the sweep angle obtained will be less than that obtained when the obstacle is a dielectric. This is due to the fact that evanescent modes are formed.

Such sources can be used with advantage in tracking antennas and FIG. 7 shows such a source placed in front of a couple of reflectors with polarizing rotation. In this figure, the main parabolic reflector 9 can be recognized with, in front of it, a reflector 90 with wires tilted at 45° with respect to the polarization vector, and an auxiliary hyperbolic reflector 10 with wires parallel to the polarization of the rotating primary source 30 placed in the antenna axis.

A microwave source for a phase conical scan antenna has thus been described whose mechanical production is simpler and easier than that of prior production and which offers improved performance mainly in the band width transmitted.

We claim:

1. A microwave primary source for a phase conical scan antenna comprising:

a fixed circular waveguide, a conical horn energized by said fixed circular wave guide in the $TE_{11}$ mode, said horn including an obstacle giving rise to a wave that propagates in the $TE_{21}$ mode in the opening plane XOY, and means causing the electric field lines of the $TE_{21}$ mode to rotate which drives the beam deviation in the obstacle symmetry plane, the fields at two symmetrical points with respect to OY being complex conjugates one with respect to the other, with the same amplitude but opposite phases the fields at two symmetrical points with respect to OX being equal.

2. A microwave primary source as claimed in claim 1, wherein the obstacle rotates inside the horn around the axis V of the latter.

3. A microwave primary source as claimed in claim 1, wherein the obstacle is fixed to the horn which rotates round its axis V.

4. A microwave primary source as claimed in claim 3, wherein the length of the obstacle is less than the length L of the horn measured along the direction of propagation, the said obstacle ending in the opening plane of the horn.

5. A microwave primary source as claimed in claim 4, wherein the length of the obstacle is of the order of 11/12 of the length L of the horn.

6. A microwave primary source as claimed in claim 3, wherein the obstacle is formed by a dielectric part with a inside face parallel to the axis V of the horn and an outside face which follows the face of the horn over an angular sector whose rise e is between 1/6 and ¼ of the diameter $\phi_1$ of the opening of the horn.

7. A microwave primary source as claimed in claim 6, wherein the dielectric constant of the material forming the obstacle is between 2 and 4.5.

8. A microwave primary source as claimed in claim 3, wherein the obstacle is formed by a metallic part of copper or aluminium.

9. An antenna for a tracking radar containing a primary source as claimed in claim 3.

* * * * *